US007334284B2

(12) United States Patent
Grey

(10) Patent No.: US 7,334,284 B2
(45) Date of Patent: Feb. 26, 2008

(54) SURFACE CLEANING APPARATUS

(75) Inventor: Nicholas Gerald Grey, Crowle (GB)

(73) Assignee: Nicholas G. Grey, Worcestershire (GB)

( * ) Notice: Subject to any disclaimer, the term of this patent is extended or adjusted under 35 U.S.C. 154(b) by 0 days.

(21) Appl. No.: 10/697,570

(22) Filed: Oct. 31, 2003

(65) Prior Publication Data

US 2004/0139993 A1 Jul. 22, 2004

(30) Foreign Application Priority Data

Nov. 2, 2002 (GB) ..... 0225618.8

(51) Int. Cl.
*A47L 11/24* (2006.01)
*A47L 11/33* (2006.01)
*A47L 11/40* (2006.01)

(52) U.S. Cl. ..... 15/52.1; 15/41.1; 15/42; 15/83

(58) Field of Classification Search ..... 15/41.1, 15/42, 52.1, 83
See application file for complete search history.

(56) References Cited

U.S. PATENT DOCUMENTS

| | | | | |
|---|---|---|---|---|
| 2,235,432 | A | 3/1941 | Kenyon | |
| 3,184,775 | A | 5/1965 | Downey et al. | |
| 3,460,188 | A | 8/1969 | Boyd | |
| 3,906,585 | A | 9/1975 | Mattsson | |
| 3,978,539 | A | 9/1976 | Yonkers et al. | |
| 4,099,284 | A | 7/1978 | Shinozaki et al. | |
| 4,177,533 | A | 12/1979 | Liebscher et al. | |
| 4,369,539 | A | 1/1983 | Nordeen | |
| 4,457,042 | A | 7/1984 | Jones et al. | |
| 4,765,012 | A | 8/1988 | Ueda | |
| 5,101,534 | A | 4/1992 | Watanabe et al. | |
| 5,224,232 | A | 7/1993 | Zahuranec et al. | |
| 5,765,258 | A | 6/1998 | Melito et al. | |
| 5,896,611 | A | 4/1999 | Haaga | |
| 2002/0100130 | A1* | 8/2002 | Fischer | 15/52.1 |
| 2003/0028982 | A1* | 2/2003 | Kress | 15/52.1 |

FOREIGN PATENT DOCUMENTS

| | | |
|---|---|---|
| DE | 18 14 398 | 9/1970 |
| DE | 7203819 | 7/1972 |
| DE | 2239135 | 2/1974 |
| DE | 1 533 494 | 7/1975 |
| DE | 3039167 | 5/1982 |
| DE | 196 01 976 | 7/1997 |
| DE | 199 14 574 | 11/2000 |
| DE | 10003883 | 8/2001 |
| DE | 10110771 | 9/2002 |

(Continued)

OTHER PUBLICATIONS

International Search Report dated Aug. 25, 2004 for Application No. EP 04 01 1243.

(Continued)

*Primary Examiner*—Randall Chin
(74) *Attorney, Agent, or Firm*—Womble Caryle

(57) ABSTRACT

A surface cleaning apparatus includes a surface cleaning strip and means responsive to movement of the surface cleaning apparatus over a surface to be cleaned for positioning the cleaning strip relative to the surface to be cleaned in dependence upon the direction of movement of the surface cleaning apparatus.

49 Claims, 6 Drawing Sheets

FOREIGN PATENT DOCUMENTS

| | | |
|---|---|---|
| EP | 0 285 096 | 10/1988 |
| EP | 1179314 | 2/2002 |
| EP | 1 319 758 A2 | 6/2003 |
| FR | 2 228 459 | 12/1974 |
| FR | 2778079 | 11/1999 |
| GB | 411428 | 6/1934 |
| GB | 855613 | 12/1960 |
| GB | 1046901 | 10/1966 |
| GB | 1374420 | 11/1974 |
| GB | 1 442 587 | 7/1976 |
| GB | 1 547 286 | 6/1979 |
| GB | 2 137 486 | 10/1984 |
| GB | 2187377 | 9/1987 |
| GB | 2 318 279 | 4/1998 |
| GB | 2351435 A | 1/2001 |
| JP | 49-55164 | 5/1974 |
| JP | 52-43378 | 9/1975 |
| JP | 55-96126 | 7/1980 |
| JP | 59-166126 | 9/1984 |
| JP | 4322625 | 11/1992 |
| JP | 05000122 | 1/1993 |
| JP | 11-276392 | 10/1999 |
| JP | 1999-0078370 | 10/1999 |
| JP | 2001061742 | 3/2001 |
| WO | WO97/15224 | 5/1997 |
| WO | WO 01/54555 | 8/2001 |
| WO | WO 02/26097 | 4/2002 |
| WO | WO 03/024292 | 3/2003 |

OTHER PUBLICATIONS

International Search Report dated Aug. 25, 2004 for Application No. EP 04 01 1244.

* cited by examiner

SURFACE CLEANING APPARATUS

This invention relates to a surface cleaning apparatus including a surface cleaning strip, such as for cleaning hard floor surfaces.

BACKGROUND OF THE INVENTION

Current vacuum cleaner attachments generally employ a flexible cleaning strip intended for cleaning hard floor surfaces, for example tiles, marble or linoleum. The flexible strip is intended to increase air speed and mechanically gather particles to assist performance. On a forward stroke the flexible strip will push particles forward. When the vacuum cleaner attachment is pulled in a rearward direction, the gathered particles are left behind by the strip and are extracted by the suction. A disadvantage is that the flexible strip can gather particles on the rearward side, away from the suction, when the attachment is pulled in a rearward direction. However, the action of the suction itself causes the majority of the particles on the rearward side of the flexible strip to pass under the flexible strip and be removed.

DESCRIPTION OF PRIOR ART

For surface cleaning apparatus which do not use suction, for example, sweeper type floor cleaning apparatus using rotatable brushes to pick up and collect particles, the presence of a flexible cleaning strip for cleaning hard floor surfaces results in particles becoming trapped behind the flexible strip when the sweeper is pulled in a rearwards direction, resulting trapped particles being kept away from the brushes and not being collected.

It is also known that the edge of a flexible cleaning strip used to clean hard floor surfaces can wear out relatively quickly due to the constant contact with the hard floor surface when in use. Flexible strips used on devices, for example, for washing hard floor surface are known to wear out relatively quickly without the benefit of a lubricating cleaning solution which reduces friction between the flexible strip and the floor.

OBJECT OF THE INVENTION

It is therefore an object of the present invention to provide a surface cleaning apparatus including a surface cleaning strip which overcomes, or at least ameliorates, the problems of known apparatus.

SUMMARY OF THE INVENTION

According to one aspect of the present invention there is provided a surface cleaning apparatus including a surface cleaning strip and means responsive to movement of the surface cleaning apparatus over a surface to be cleaned for positioning the cleaning strip relative to the surface to be cleaned in dependence upon the direction of movement of the surface cleaning apparatus.

The cleaning strip may be mounted on a support means which is movable between first and second positions by the positioning means in response to movement of the surface cleaning apparatus.

According to another aspect of the present invention there is provided a surface cleaning apparatus including a surface cleaning strip and means responsive to movement of the surface cleaning apparatus over a surface to be cleaned for positioning the cleaning strip relative to the surface to be cleaned in dependence upon the direction of movement of the surface cleaning apparatus, wherein the cleaning strip is mounted on a support means which is movable between first and second positions by the movement responsive means in response to movement of the surface cleaning apparatus.

The movement responsive means may comprise at least one motion detector, such as an electronic motion detector.

Alternatively, the movement responsive means may comprise means adapted to frictionally engage the surface to be cleaned.

The friction engagement means may be adapted to be moved in a first direction relative to a body of the apparatus in response to movement of the apparatus in a first direction relative to a surface to be cleaned, movement of the friction engagement means in the first direction being transmitted to the cleaning strip to cause the cleaning strip to adopt a first orientation or elevation relative to the body of the apparatus whereby in use the strip member is in contact with the surface to be cleaned.

The friction engagement means may be adapted to be moved in a second direction, opposite to the first direction, relative to the body of the apparatus in response to movement of the apparatus in a second direction, opposite to the first direction, relative to a surface to be cleaned, movement of the friction engagement means in the second direction being transmitted to the cleaning strip to cause the cleaning strip to adopt a second orientation or elevation relative to the body of the apparatus whereby in use the strip member is raised clear of the surface to be cleaned.

The friction engagement means may be mounted pivotably and may be provided with an arm engaging the cleaning strip, whereby pivoting movement of the friction engagement means as a result of movement of the apparatus is transmitted to the cleaning strip to raise and lower the cleaning strip.

The cleaning strip may be pivotably mounted for raising and/or lowering the strip.

Alternatively, the cleaning strip and the friction engagement means may be mounted on an elongate member which is pivotably mounted relative to the body of the apparatus, whereby contact between the friction engagement means and a surface to be cleaned causes rotation of the elongate member such that the cleaning strip adopts one of the first and second orientations.

The cleaning strip and the friction engagement means may project substantially radially from the elongate member, for example at different angles relative to each other. There may be an included angle of substantially 45 degrees between the cleaning strip and the friction engagement means.

The friction engagement means may be in the form of a tab extending from the elongate member.

The elongate member may be made of a flexible material, for example a plastics or rubber material.

The cleaning strip and/or the friction engagement means may be formed integrally with the elongate member.

Alternatively, the cleaning strip may be mounted on an elongate member, the elongate member being formed with a recessed groove and the cleaning strip being formed with a projection of complementary configuration adapted to retain the cleaning strip in the groove. The groove and the projection may be substantially T-shaped.

The cleaning strip may be configured to extend towards the surface to be cleaned by 2.5 to 8 mm, for example by substantially 4.5 mm.

The apparatus may include means for inhibiting movement of the cleaning strip in the longitudinal direction thereof. The movement inhibiting means may be movable or removable to allow replacement of the strip.

The cleaning strip may be made of a flexible material, for example a plastics or rubber material.

The friction engagement means may comprise a flexible material, for example a plastics or rubber material.

For a better understanding of the present invention and to show more clearly how it may be carried into effect reference will now be made, by way of example, to the accompanying drawings in which:

DESCRIPTION OF PREFERRED EMBODIMENTS

Figure 1:
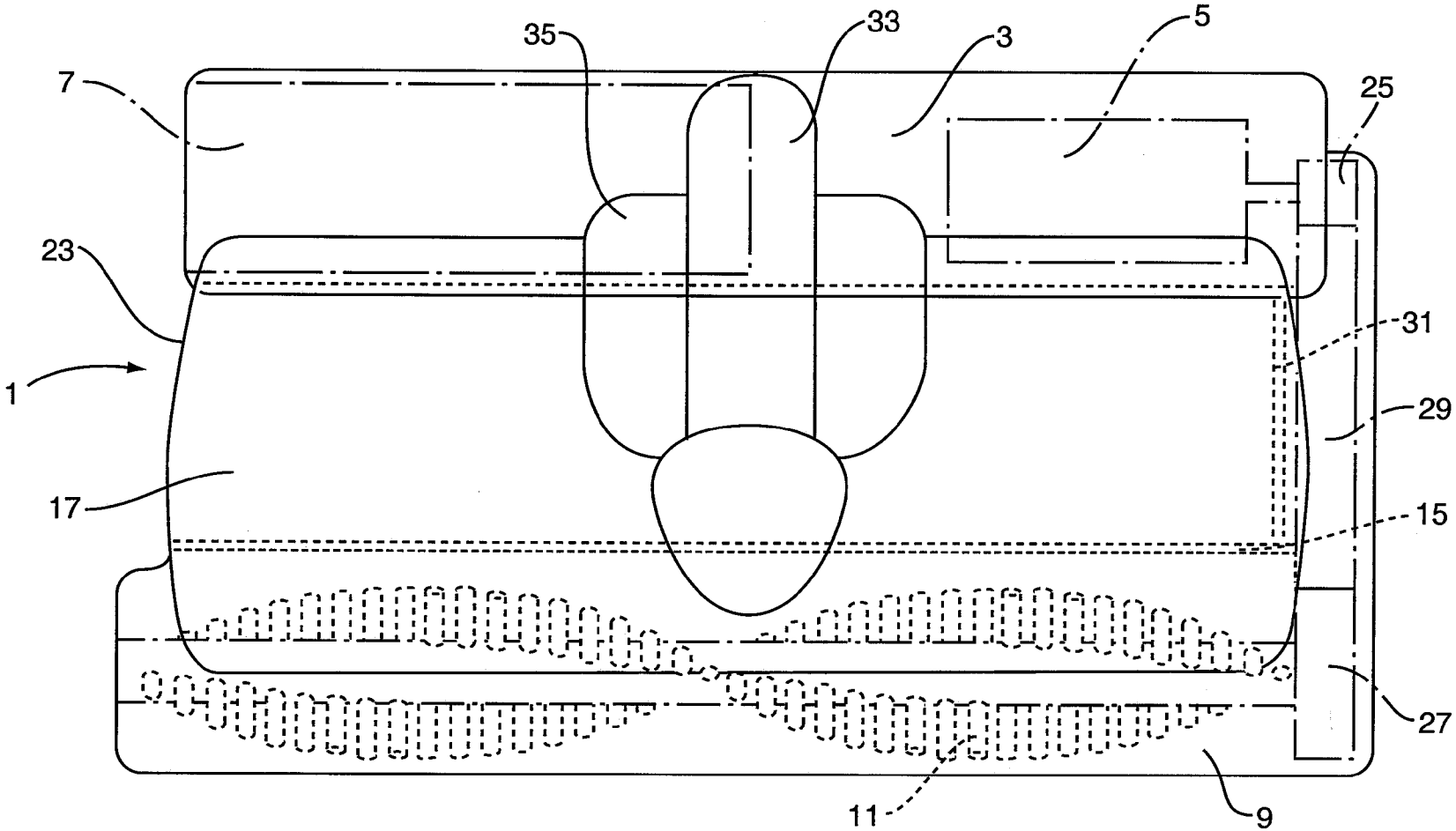
FIG. 1 is a plan view of one embodiment of a surface cleaning apparatus for use with the present invention.
Figure 2:
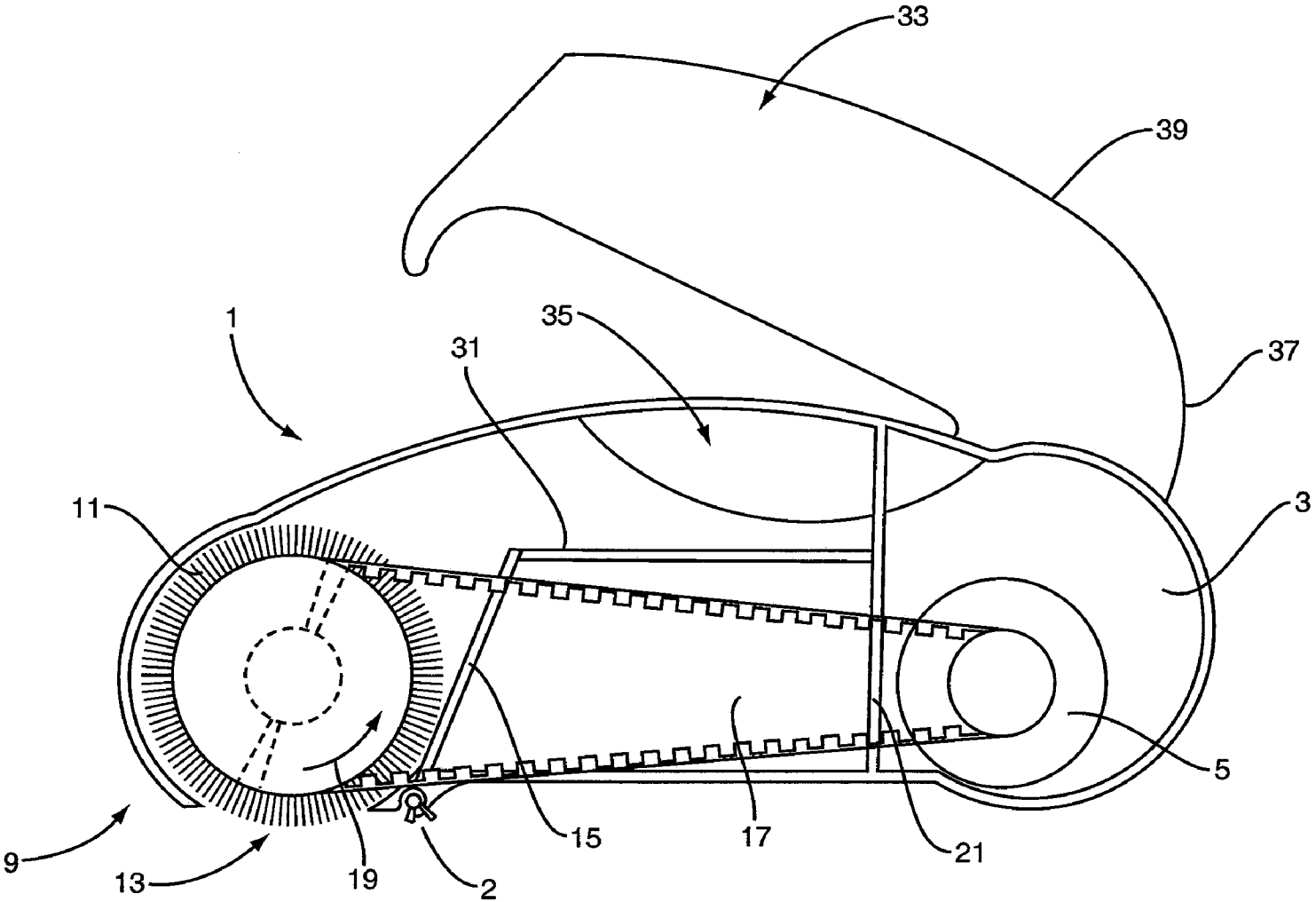
FIG. 2 is a side elevational view, partly in section, of the surface cleaning apparatus shown in FIG. 1 and showing a cleaning strip assembly.
Figure 3:
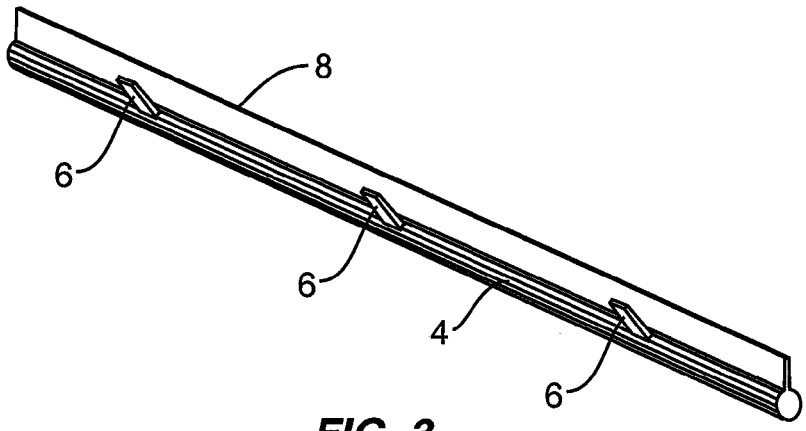
FIG. 3 is a perspective view of a cleaning strip assembly for use in the apparatus of FIGS. 1 and 2.

The surface cleaning apparatus incorporating the cleaning strip shown in FIGS. 1 to 3 comprises a body 1, suitably moulded of plastics material, and having effectively three compartments.

A rear compartment 3 houses an electric motor 5 and a rechargeable battery pack 7. The battery pack 7 may be connected to a mains power supply (not shown) for recharging the battery pack. The battery pack may either be connected to the mains supply whenever the apparatus is not in use or at suitable times when the battery pack has become depleted. Switch means (not shown) is provided to permit a user to energise and de-energise the motor 5 as desired. As an alternative to a rechargeable battery pack, the apparatus could employ disposable batteries or be mains powered.

A forward compartment 9 houses an elongate rotatable brush arrangement 11. For convenience a forward wall of the forward compartment is arcuate and extends around the periphery of the brush arrangement 11. The bottom of the forward compartment is open at 13 to allow the bristles of the brush arrangement to contact a floor, carpet or the like over which the surface cleaning apparatus is to be moved.

The rear of the forward compartment is a rearwardly inclined wall 15 which allows debris, such as dust, dirt and the like, to be propelled up the wall due to rotation of the brush arrangement 11 and to pass over the wall into an intermediate compartment 17 which will be described in more detail hereinafter. The wall 15 extends upwardly to about the same height as the top of the brush arrangement 11 and is angled rearwardly (i.e., away from the forward compartment) at an angle of about 18 degrees. The precise angle is not important, but the inclination facilitates the passage of the debris up and over the wall and at the same time facilitates retention of the debris within the intermediate compartment 17.

The brush arrangement extends substantially the entire width of the forward compartment and is provided with two helically arranged rows of bristles. The two rows are diametrically opposed and each row is in the form of a pair of separate helices which twist in opposite directions and meet substantially midway between the ends of the brush arrangement. The brush arrangement comprises bristles. The length of the bristles, for example, is in a range from 8 mm to 25 mm, preferably a range from 14 mm to 17 mm. The thickness of individual bristles is in a range from 0.04 mm to 0.3 mm, preferably in a range from 0.06 mm to 0.25 mm The bristles are arranged in tufts and the tufts have a diameter in a range from 1.5 mm to 5 mm, preferably a range from 2 mm to 3 mm.

The intermediate compartment 17, shown in FIGS. 1 and 2, is positioned between the wall 15 and a wall 21 which encloses the electrical components 5, 7 in the rear compartment 3, the wall 21 protecting the components in the rear compartment from the ingress of debris. The intermediate compartment 17 also has a lower wall, an upper wall and side walls formed by the outer wall of the body 1. Debris therefore accumulates within the intermediate compartment 17. The intermediate compartment is provided with a removable closure to facilitate the removal of debris. For example, one of the walls, such as a side wall, the upper wall or the lower wall, can be removed in order that the debris can be emptied from the intermediate compartment, the removed wall being replaced once the compartment has been emptied. Ideally, side wall 23 is removable for emptying purposes. The wall 15 provides the advantage that debris does not readily escape from the intermediate compartment 17 and, even if the body is inclined such that the forward compartment is below the intermediate compartment, the debris does not escape from the intermediate compartment.

The brush arrangement 11 is rotated by the motor 5 in the direction 19 by way of toothed rollers 25, 27 attached to the motor and to the brush, respectively, and by way of a toothed belt 29, for example of elastomeric material, extending around the two rollers. The toothed belt 29 is enclosed within a tunnel 31 where it passes through the intermediate compartment 17 in order to prevent the ingress of debris into the rear compartment 3. The tunnel 31 may pass through the intermediate compartment 17 at any convenient point. However, particularly in the event side wall 23 is removable for emptying purposes, the tunnel may be arranged at that side of the intermediate compartment 17 remote from the side wall 23.

The cleaning strip assembly 2 as shown in FIG. 3 comprises an elongate support member 4 comprising a flexible material, for example rubber or a plastics material, with a substantially circular cross-section. Formed integral with the elongate member 4 are a series of spaced apart flexible tabs 6. Also formed integral with the elongate member 4 is a flexible strip 8 positioned along substantially the entire length of the elongate member. The thickness of the flexible strip 8 decreases progressively towards an edge furthest from the elongate member. The flexible strip need not be integral with the elongate support member 4. As an alternative, the support member 4 may be formed with a recessed groove extending in the axial direction and the flexible strip 8 may be formed with a projection of complementary configuration to retain the flexible strip in the groove. The groove and the projection may conveniently be substantially T-shaped.

The flexible strip may have any convenient length, for example in the range from 2.5 to 8 mm. However, a length of substantially 4.5 mm has been found to be particularly suitable.

The flexible tabs 6 and the flexible strip 8 are positioned on the elongate member substantially at an angle relative to each other of approximately 45 degrees. The flexible tabs and flexible strip extend in a generally radial direction from the elongate member, and are directed, in use, towards the lower face of the body of the surface cleaning apparatus.

Figure 5A:
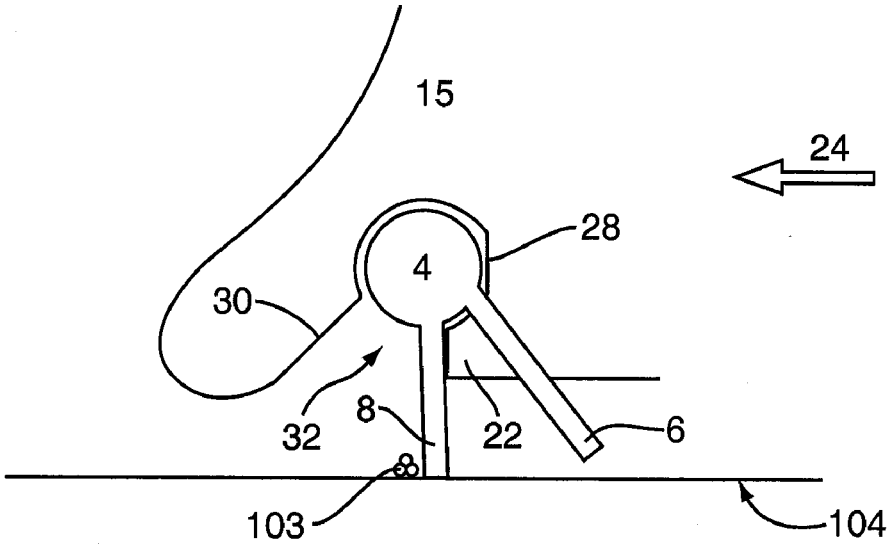
FIGS. 5*a* and 5*b* are a perspective view of the cleaning strip in a first and a second orientation.
Figure 5B:
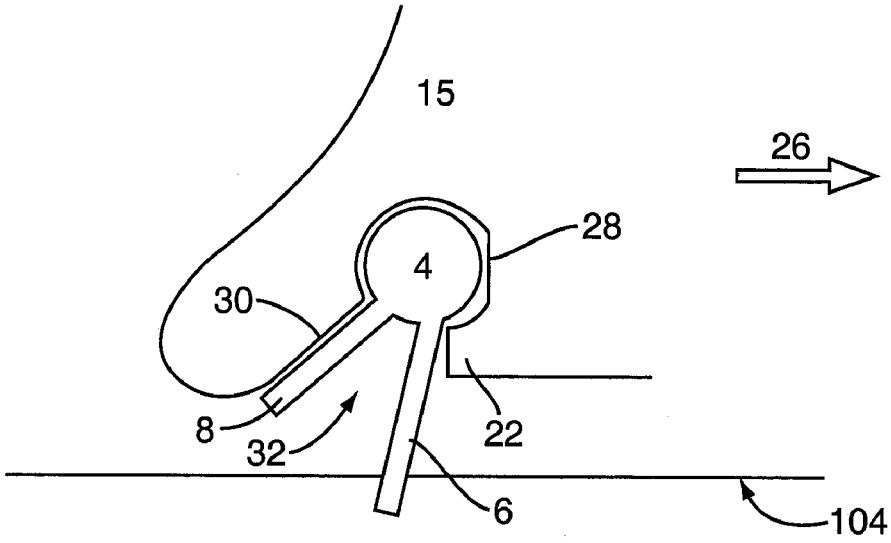

The elongate member of the cleaning strip assembly is housed within a cavity in the underside of the wall 15 of the surface cleaning apparatus so as to be rotatable about the axis of the elongate member. The cleaning strip assembly is orientated such that the flexible strip is nearest to the front of the surface cleaning apparatus and the flexible tabs are nearer to the rear of the surface cleaning apparatus. The cavity has an open face through which the flexible strip and the flexible tabs protrude. As shown in FIGS. 5*a* and 5*b*, the cavity has a first major wall, the rear wall in use, which is substantially upright, and a second major wall. The second major wall, the front wall in use, is inclined away from the rear wall at a nominal angle of 60 degrees. The inner face of the cavity, opposite the opening, is in the form of a concave curved surface wherein the curvature complements the curvature of the elongate member. The elongate member is retained within the cavity by retaining tabs attached to the rear wall of the cavity at the open face of the cavity. The cavity in the wall 15 is shaped such that excessive rotation of the elongate member in either direction is prevented by the walls of the cavity engaging the flexible tabs or flexible strip.

Lateral movement of the elongate member may be inhibited by any suitable means. For example a cover for part of the drive mechanism may be provided with a protrusion which extends sufficiently to cover the end of the elongate member. Removal of the cover then exposes the end of the elongate member and allows it to be removed, for example for replacement.

Figure 4:
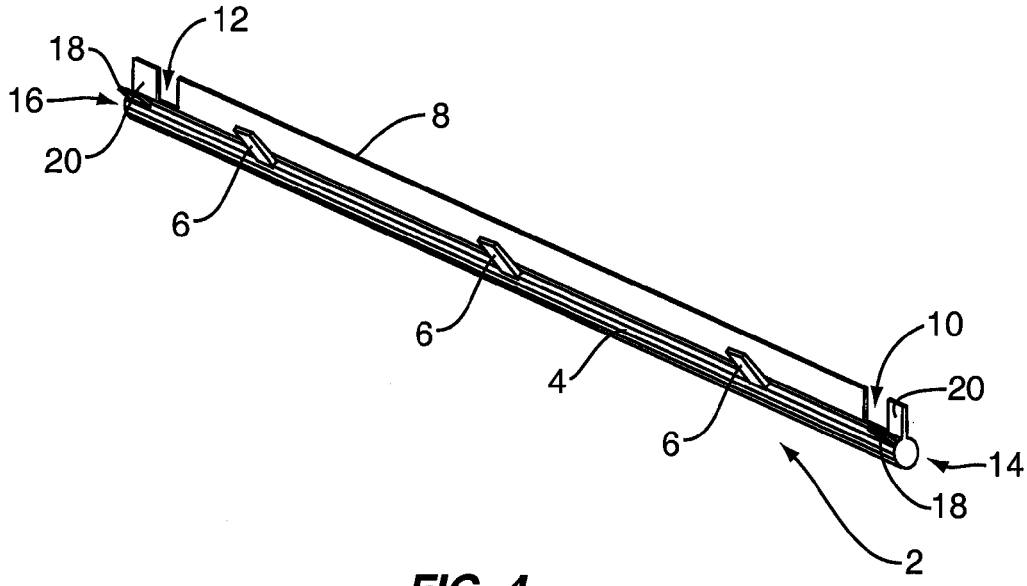
FIG. 4 is a perspective view of another cleaning strip assembly for use in the apparatus of FIGS. 1 and 2.

FIG. 4 shows an alternative embodiment of the cleaning strip assembly in which the flexible strip has a first section 10 and a second section 12 positioned close to a first end 14 and to a second end 16, respectively, of the elongate member 4 at which material of the flexible strip is absent such that an isolated portion 20 of the flexible strip is provided at the ends 14, 16 of the elongate member. In use, the isolated portions 20, in conjunction with restraining pins 18 provided on the ends 14, 16 of the elongate member, impinge on retaining tabs of the cavity, such that the ends of the elongate member are prevented from being pulled towards each other during flexure of the elongate member.

A handle 33 is attached to the body 1 in the region of the rear compartment 3, the body being formed with a recess 35 beneath the handle to allow the handle to be gripped while maintaining a low profile for the surface cleaning apparatus. The handle 33 may be in two parts, a first part 37 which is secured to the body 1 and a second part 39 which can be removed from the first part and replaced by a longer handle part (not shown). The longer handle part may be provided with swivel means to allow the handle part to rotate about the axis thereof relative to the body 1 and with pivot means to allow the handle part to pivot about an axis transverse to the axial direction of the handle part to enable the surface cleaning apparatus to be steered by the user.

Although not shown, the rear compartment 3 may be provided with ground-engaging wheels in order to assist mobility of the surface cleaning apparatus. The ground-engaging wheels may, for example, be formed externally in the side regions of the rear compartment 3 or may be provided within recesses formed at least partly beneath the rear compartment 3.

Although the illustrated embodiments of the present invention are intended primarily for domestic use, the surface cleaning apparatus can also be used outdoors or in workshops if desired. However, it may be preferable to provide a more rugged design specifically adapted for such use.

In use of the surface cleaning apparatus incorporating the cleaning strip assembly according to the invention, as shown in FIGS. 1 to 5*b* the surface cleaning apparatus is placed upon a surface to be swept, such as a carpet, and the switch operated to energise the motor and consequently to rotate the brush arrangement to sweep debris from the surface and then propel the debris up and over the inclined wall 15 and into the intermediate compartment 17 where it is temporarily stored. As the surface cleaning apparatus is moved over the surface with the brush arrangement 11 rotating, any further debris is similarly swept from the surface and propelled up and over the wall 15 and into the intermediate compartment 17.

The cleaning strip assembly 2 is used to ensure that efficient cleaning of surfaces, for example hard floor surfaces, is achieved. As shown in FIG. 5A, when the surface cleaning apparatus is pushed forward 24 over a surface 104 to be cleaned, the flexible tabs 6 of the cleaning strip respond to movement of the apparatus by being dragged backwards by friction with the floor causing the elongate member 4 to rotate about its axis. Rotation of the elongate member brings the flexible strip 8 into contact with the floor. Continued forward movement of the surface cleaning apparatus results in the flexible strip being held in contact with the surface and particles of dirt 103 on the surface to be cleaned are gathered together and pushed forward along with the movement of the surface cleaning apparatus. Excessive rotation of the elongate member 4, when the surface cleaning apparatus is pushed forwards 24, is prevented by the rear face of the flexible strip engaging on the retaining tabs 22 which retain the elongate member within the cavity 32 of the wall 15. Further rotation is also prevented by the flexible tabs 6 engaging the rear wall 28 of the cavity 32.

FIG. 5B shows, when the surface cleaning apparatus is moved in a rearward direction 26, the flexible strip 8 responds to movement of the apparatus by being dragged towards the front of the surface cleaning apparatus by friction with the surface 104 to be cleaned. In dragging the flexible strip forwards, the elongate member 4 of the cleaning strip assembly is rotated such that the flexible tabs 6 are brought into contact with the floor 104. The flexible tabs 6 are also dragged towards the front of the surface cleaning apparatus so resulting in continued rotation of the elongate member and the subsequent lifting of the flexible strip clear of the floor. Excessive rotation of the elongate member is prevented by the flexible strip engaging the inclined front wall 30 of the cavity 32 in wall 15 and being stopped from further forward movement. When the surface cleaning apparatus is pulled in a rearward direction, the particles of dirt gathered together by the flexible strip during use in the forward direction are swept from the surface by the brush arrangement and propelled up and over the wall 15 and into the intermediate compartment 17. As the flexible strip is clear of the floor, additional particles of dirt can pass between adjacent flexible tabs and are not prevented from passing under the flexible strip.

The surface cleaning apparatus is extremely portable and can be employed wherever it may be required. For example, it can be used to sweep stairs without the need for electrical leads or suction hoses. The shape of the apparatus with the rounded shape of the rear compartment as illustrated facilitates movement of the apparatus over stairs, but ground engaging wheels may be provided to further facilitate such sweeping operations.

When the intermediate compartment 17 is to be emptied, one wall of the compartment is removed as explained above and the debris can readily be discharged. The removable wall is then replaced. Alternatively, the intermediate compartment may be in the form of a tray which can be removed and emptied so as to discharge debris.

When the surface cleaning apparatus is not in use, it can be stored, for example either in a cupboard or the like or plugged into a mains supply in order to recharge the battery 7.

Thus the illustrated surface cleaning apparatus incorporating the cleaning strip assembly of the present invention incorporates an electrically driven brush arrangement. The brush arrangement is not driven by frictional forces between the surface cleaning apparatus and the surface over which it is to be moved. Thus, efficiency of the apparatus is not dependent on the nature of the frictional contact. Further, the apparatus does not rely on suction means to draw the debris into a storage chamber. Thus, efficiency of the apparatus is not dependent on the effectiveness of suction means and the substantial power drain of suction means on the rechargeable battery is avoided. The provision of the motor at the rear of the apparatus eliminates the need for increased height should the motor be positioned over the compartment for collecting dust and the like and also provides effective full width cleaning which would not be possible if the motor was to be positioned within the compartment for collecting debris. In such a position, debris is likely to accumulate around the motor and cause blockages. The illustrated apparatus overcomes this problem by passing the drive means for the brush arrangement at least partly through the debris compartment.

Although the cleaning strip assembly described hereinbefore is shown as comprising an elongate member with a substantially circular cross-sectional area having attached thereto at least one tab and a strip member, it should be appreciated that the cleaning strip assembly may take other embodiments and the moving of the strip member relative to a floor may be achieved by other methods rather than by rotation of the elongate body of the cleaning strip assembly.

Figure 6A:
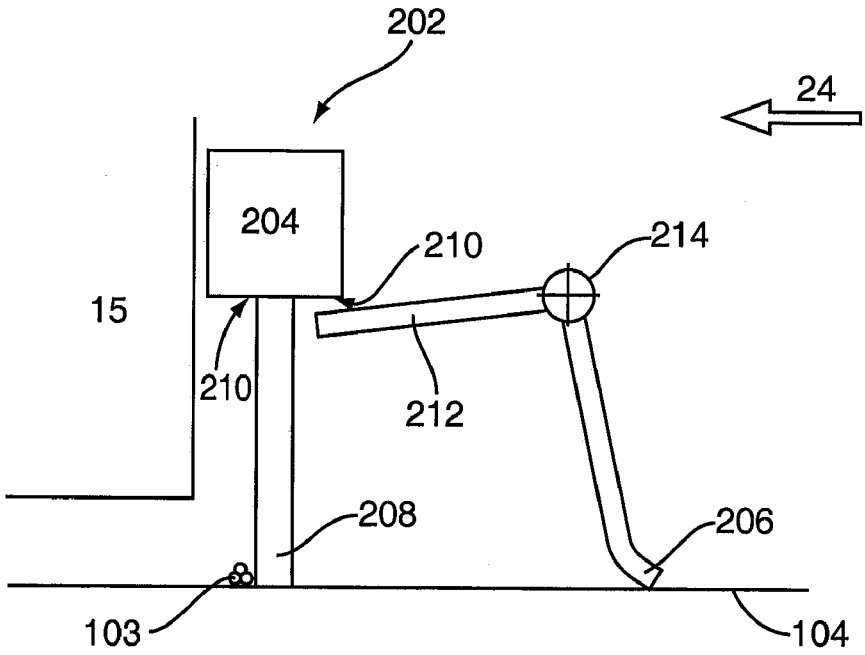
FIGS. 6*a* and 6*b* are a side elevational view of an alternative embodiment of a cleaning strip assembly in a lowered and raised position, showing the relationship between the cleaning strip and a separate friction means.
Figure 6B:
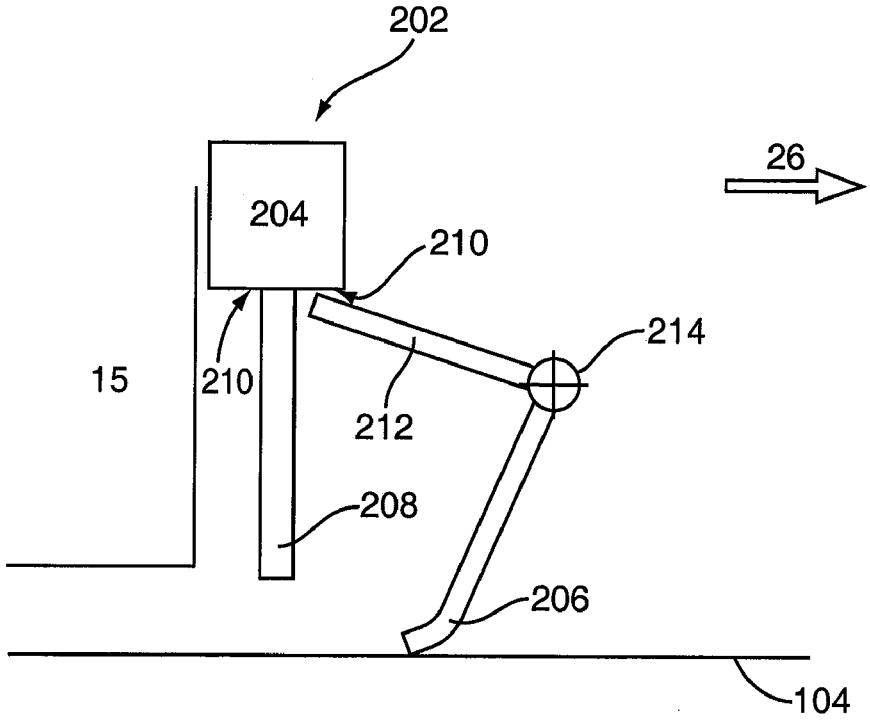

FIGS. 6*a* and 6*b* show another embodiment of a cleaning strip assembly 202 which comprises an elongate member 204 of rigid material, for example plastics material, which is attached to a flexible strip 208, for example of a plastics or rubber material, positioned along substantially the entire length of the elongate member 204. The thickness of the flexible strip 208 decreases progressively towards an edge furthest from the elongate member. The thickness of the flexible strip is less than that of the elongate body such that a shoulder portion 210 is formed either side of the flexible strip where it is attached to the elongate member.

The flexible strip is directed, in use, towards the lower face of the body of the surface cleaning apparatus.

The elongate member of the cleaning strip assembly is housed within the cavity (not shown) in the underside of the wall 15 of the surface cleaning apparatus so as to be movable in a substantially upright plane relative to the floor. The cavity also contains an arm 212 fixed at one end to a pivot pin 214 which can rotate about a fixed axis within the cavity. In use, the fixed axis of the pivot pin 214 is substantially parallel to the surface of the floor. The end of the arm 212 furthest from the pivot pin is positioned beneath a shoulder portion 210 of the cleaning strip assembly. Also attached to the pivot pin 214 within the cavity are a number of flexible tabs 206. The free end of each tab 206, in use, is in contact with the floor 104.

The cavity has an open face through which the flexible strip and the flexible tabs protrude. The elongate member 204 is retained within the cavity by means of the arm 212 positioned below the shoulder portion 210 of the cleaning strip assembly.

As shown in FIG. 6A, when the surface cleaning apparatus is pushed forward 24 over a surface 104 to be cleaned, the flexible tabs 206 of the cleaning strip assembly are dragged backwards by friction with the floor causing the arm 212 to pivot about the fixed axis of the pivot pin 214 towards the floor. Pivoting of the arm away from the shoulder portion 210 of the cleaning strip assembly allows the elongate member of the cleaning strip assembly to lower and bring the flexible strip 208 into contact with the floor. Particles of dirt 103 on the surface to be cleaned are gathered together by the flexible strip and pushed forward along with the movement of the surface cleaning apparatus.

FIG. 6B shows, when the surface cleaning apparatus is moved in a rearward direction 26, the flexible tabs are dragged towards the front of the surface cleaning apparatus by friction with the surface 104 to be cleaned. In dragging the flexible tabs forwards, the arm 212 pivots away from the floor about the fixed axis of the pivot pin 214. The arm 212, positioned under the shoulder 210 of the cleaning strip assembly, urges the cleaning strip assembly in a substantially upward direction such that the flexible strip 208 is lifted clear of the floor.

When the surface cleaning apparatus is pulled in a rearward direction, the particles of dirt gathered together by the flexible strip during use in the forward direction are swept from the surface by the brush arrangement. As the flexible strip is clear of the floor, additional particles of dirt can pass between adjacent flexible tabs and are not prevented from passing under the flexible strip.

Figure 7:
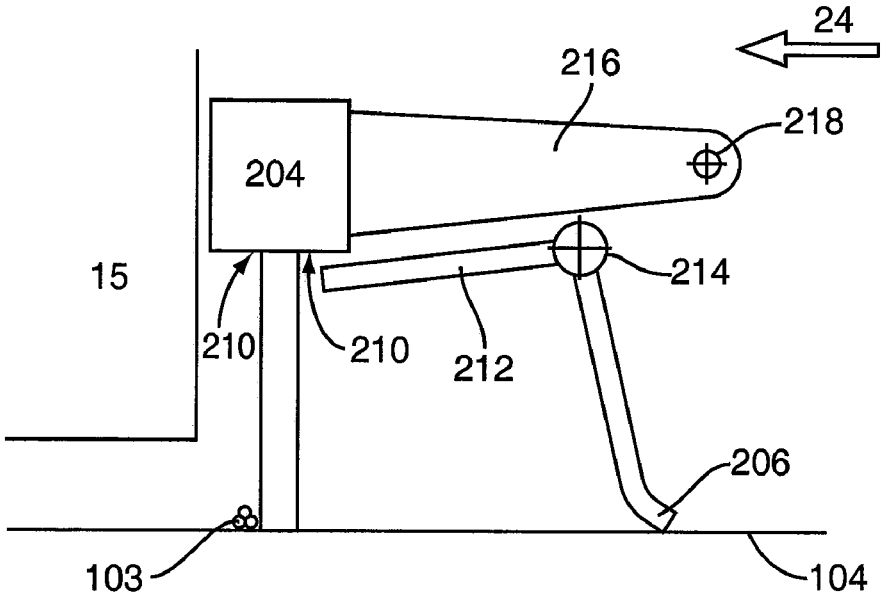
FIG. 7 is side elevational view of a further embodiment of a cleaning strip assembly in a lowered position.

FIG. 7 shows a further embodiment of the cleaning strip assembly, wherein the cleaning strip assembly comprises an elongate member 204 of rigid material, for example plastics material, which is attached to a flexible strip 208 positioned along substantially the entire length of the elongate member. The thickness of the flexible strip 208 decreases progressively towards an edge furthest from the elongate member. The thickness of the flexible strip is less than that of the elongate body such that a shoulder portion 210 is formed either side of the flexible strip where it is attached to the elongate member.

The cavity also contains a first arm 212 fixed at one end to a pivot pin 214 which can rotate about a first fixed axis within the cavity. The end of the first arm 212 furthest from the pivot pin 214 is positioned beneath a shoulder portion 210 of the cleaning strip assembly. Also attached to the pivot pin within the cavity are a number of flexible tabs 206. The free end of each tab 206, in use, is in contact with the floor 104.

Attached to the elongate body 204 is a second arm 216 which connects the cleaning strip assembly 202 to a second pivot pin 218 within the cavity in the wall of the surface cleaning apparatus. The elongate member of the cleaning strip assembly is housed within the cavity of the surface cleaning apparatus so as, when in use, to be pivotably moved on the second arm 216 relative to the floor about an axis of the second pivot pin 218 substantially parallel with the surface of the floor.

The cavity comprises an open face through which the flexible strip and the flexible tabs protrude. The elongate member is retained within the cavity by means of the first arm 212 positioned below the shoulder portion 210 of the cleaning strip assembly and by means of the second arm 216 attaching the cleaning strip assembly to the second pivot pin 218.

When the surface cleaning apparatus is pushed forward 24 over a surface 104 to be cleaned, the flexible tabs 206 of the cleaning strip assembly are dragged backwards by friction with the floor causing the first arm 212 to pivot towards the floor about the axis of the first pivot pin 214. Pivoting of the first arm 212 allows the elongate member of the cleaning strip assembly to pivot on the second arm 216 about the axis of the second pivot pin 218 and so bring the flexible strip 208 into contact with the floor. As described hereinabove, particles of dirt 103 on the surface to be cleaned are gathered together by the flexible strip and pushed forward along with the movement of the surface cleaning apparatus.

When the surface cleaning apparatus is moved in a rearward direction the flexible tabs are dragged towards the front of the surface cleaning apparatus by friction with the surface 104 to be cleaned. In dragging the flexible tabs forwards, the first arm 212 pivots away from the floor about the axis of the first pivot pin 214. The first arm, positioned under the shoulder 210 of the cleaning strip assembly, urges the cleaning strip assembly in a substantially upward direction such that the flexible strip is lifted clear of the floor and pivots, via the second arm 213, about the axis of the second pivot pin 218.

When the surface cleaning apparatus is pulled in a rearward direction, the particles of dirt gathered together by the flexible strip during use in the forward direction are swept from the surface by the brush arrangement. As the flexible strip is clear of the floor, additional particles of dirt can pass between adjacent flexible tabs and are not prevented from passing under the flexible strip.

Figure 8:
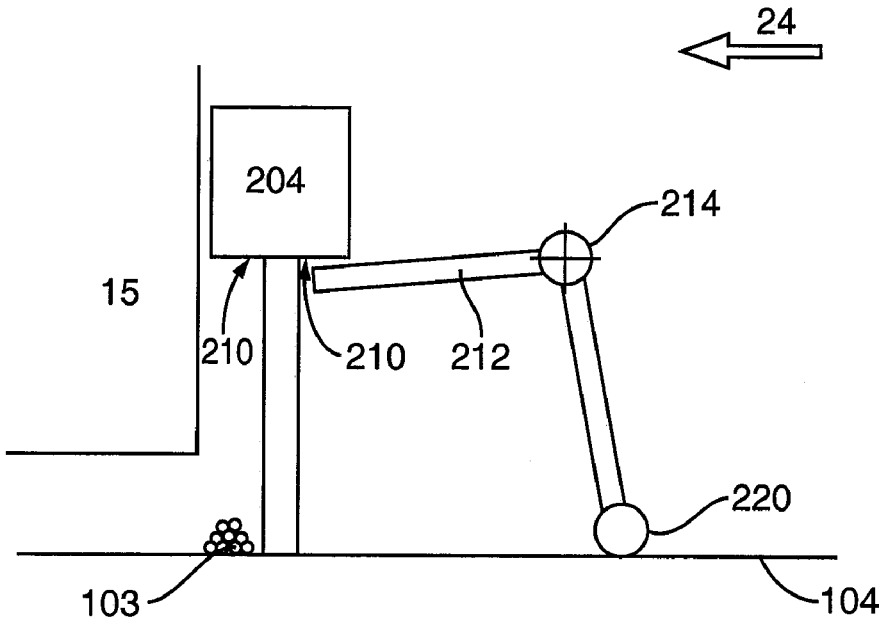
FIG. 8 is a side elevational view of the cleaning strip assembly of FIG. 6 showing an alternative form of friction means.

It should be understood that an alternative to the flexible tabs described hereinabove could be a friction wheel 220, as shown in FIG. 8, whereby movement of the friction wheel 220 relative to the floor can be used to cause an arm 212 beneath the shoulder portion 210 of the cleaning strip assembly to be moved thus raising and lowering the cleaning strip assembly as described hereinabove.

It should be understood that electronic or other means may be used in place of frictional means to determine the movement of the surface cleaning apparatus and for controlling the positioning of the flexible strip.

I claim:

1. A surface cleaning apparatus, comprising:

a) a body having a forward compartment and rear compartment, wherein the forward compartment includes a wall;

b) an elongate rotatable brush extending across the forward compartment and positioned to propel debris up the wall;

c) an electric motor in the rear compartment;

d) a belt connecting the motor and rotatable brush; and e) a cleaning strip assembly pivotably mounted on an underside of the body, the cleaning strip assembly comprising an elongate support member housed within an underside of the wall, a flexible strip extending along substantially the entire length of the elongate support member, and a plurality of tabs for engaging a surface being cleaned, the engagement of the plurality of tabs with the surface being capable of causing the cleaning strip assembly to pivot between a cleaning position and an elevated position.

2. The apparatus of claim 1, wherein flexible strip extends radially from the support member along substantially the entire length of the elongate support member.

3. The apparatus of claim 1, wherein the plurality of tabs cause the cleaning strip assembly to pivot into a cleaning position when the surface cleaning apparatus moves in a first direction.

4. The apparatus of claim 1, wherein the plurality of tabs cause the cleaning strip assembly to pivot into an elevated position when the surface cleaning apparatus moves in a second direction.

5. The apparatus of claim 1, further comprising an intermediate compartment defined by the wall, which is between the forward compartment and the intermediate compartment, a wall between the intermediate compartment and the rear compartment, and side walls.

6. The apparatus of claim 5, wherein one side wall is removable to facilitate removal of debris.

7. The apparatus of claim 6, wherein the removable side wall includes a cover.

8. The apparatus of claim 5, wherein the belt is enclosed within a tunnel that passes through the intermediate compartment.

9. The apparatus of claim 8, wherein one side wall is removable to facilitate removal of debris and the tunnel is arranged at a side remote from the removable side wall.

10. The apparatus of claim 5, wherein the wall between the forward and intermediate compartments is inclined rearwardly.

11. The apparatus of claim 5, wherein the wall between the intermediate and rear compartments seals the rear compartment from the intermediate compartment.

12. The apparatus of claim 1, wherein a front part of the forward compartment is movable to expose bristles on the elongate rotatable brush at the front part of the forward compartment.

13. The apparatus of claim 1, wherein the rear compartment is provided with ground-engaging wheels.

14. The apparatus of claim 1, further comprising a handle rotatable about an axial direction of the handle to facilitate steering of the apparatus.

15. The apparatus of claim 14, wherein the handle is further pivotable about an axis transverse to the axial direction of the handle.

16. A surface cleaning apparatus comprising:

a housing;

an elongate brush arrangement mounted so as to be rotatable about a longitudinal axis thereof, extending across the housing for contacting a surface to be cleaned, and positioned to propel debris up a wall within the housing;

a substantially continuous surface cleaning strip extending across an underside of the housing;

movement responsive means including friction engaging means adapted to engage the surface to be cleaned and movable in opposing first and second directions in response to movement of the apparatus in opposing first and second directions relative to the surface to be cleaned, movement of the friction engaging means being transmitted to the cleaning strip; and movement stop means adapted to allow the cleaning strip to adopt a first orientation, a second orientation, and orientations between the first orientation and second orientation, and to prevent the cleaning strip from adopting orientations beyond the first orientation or second orientation, wherein the cleaning strip and the friction engaging means are mounted on an elongate member which is pivotably mounted within an underside of the wall, whereby contact between the friction engaging means and the surface to be cleaned causes the elongate member to pivot such that the cleaning strip adopts one of the first and second orientations.

17. An apparatus as claimed in claim 16, wherein the cleaning strip is mounted on a support which is movable between first and second positions by the movement responsive means in response to movement of the surface cleaning apparatus.

18. An apparatus as claimed in claim 16, wherein the cleaning strip and the friction engaging means project substantially radially from the elongate member.

19. An apparatus as claimed in claim 18, wherein the cleaning strip and the friction engaging means extend at different angles relative to each other.

20. An apparatus as claimed in claim 19, wherein an included angle between the cleaning strip and the friction engaging means is substantially 45 degrees.

21. An apparatus as claimed in claim 16, wherein the friction engaging means comprises a tab extending from the elongate member.

22. An apparatus as claimed in claim 16, wherein the elongate member comprises a flexible material.

23. An apparatus as claimed in claim 16, wherein the cleaning strip and the friction engaging means are formed integrally with the elongate member.

24. An apparatus as claimed in claim 16, wherein the elongate member comprises a recessed groove and the cleaning strip comprises a projection of complementary configuration adapted to retain the cleaning strip in the recessed groove.

25. An apparatus as claimed in claim 24, wherein the recessed groove and the projection are substantially T-shaped.

26. An apparatus as claimed in claim 16, wherein the cleaning strip is configured to extend towards the surface to be cleaned by 2.5 to 8 mm.

27. An apparatus as claimed in claim 26, wherein the cleaning strip is adapted to extend by substantially 4.5 mm.

28. An apparatus as claimed in claim 16, further comprising means for inhibiting the movement of the cleaning strip in the longitudinal direction thereof.

29. An apparatus as claimed in claim 28, wherein the movement inhibiting means is movable to allow replacement of the cleaning strip.

30. An apparatus as claimed in claim 28, wherein the movement inhibiting means is removable to allow replacement of the cleaning strip.

31. An apparatus as claimed in claim 16, wherein the cleaning strip comprises a flexible material.

32. An apparatus as claimed in claim 16, wherein the friction engaging means comprises a flexible material.

33. An apparatus as claimed in claim 16, further comprising a motor provided within the housing for rotating the brush arrangement.

34. An apparatus as claimed in claim 33, further comprising a battery within the housing for energizing the motor.

35. An apparatus as claimed in claim 34, wherein the battery is rechargeable.

36. A surface cleaning apparatus comprising:

a housing;

an elongate rotatable brush arrangement extending across the housing and positioned to propel debris up a wall within the housing;

an elongate support member housed in a cavity in an underside of the wall;

a substantially continuous surface cleaning strip extending across an underside of the housing, the surface cleaning strip being mounted on the elongate support member, the elongate support member being rotatable between a cleaning orientation where the surface cleaning strip contacts a surface to be cleaned, and a second orientation where the surface cleaning strip is raised clear of the surface to be cleaned; and at least one surface engagement structure mounted on the elongate support member in an orientation relative to the surface cleaning strip such that in the cleaning orientation the surface engagement structure contacts a wall of the cavity, and in the second orientation the surface engagement structure contacts the surface to be cleaned;

wherein movement of the surface engagement structure in a cleaning direction causes the cleaning strip to adopt the cleaning orientation and wherein movement of the surface engagement structure in a direction opposite to the cleaning direction causes the cleaning strip to adopt the second orientation.

37. An apparatus as claimed in claim 36, wherein the cleaning strip and the surface engagement structure project substantially radially from the elongate member.

38. An apparatus as claimed in claim 37, wherein the cleaning strip and the surface engagement structure extend at different angles relative to each other.

39. An apparatus as claimed in claim 38, wherein an included angle between the cleaning strip and the surface engagement structure is substantially 45 degrees.

40. An apparatus as claimed in claim 36, wherein the surface engagement structure comprises a tab extending from the elongate member.

41. The apparatus of claim 36, wherein in the second orientation the surface cleaning strip contacts a second cavity wall.

42. A surface cleaning apparatus, comprising:

a body having a forward compartment and rear compartment, wherein the forward compartment includes a rear wall;

an elongate rotatable brush extending across the forward compartment and positioned to propel debris up the wall;

a belt connecting an electric motor to the rotatable brush; and a cleaning strip assembly pivotably mounted on an underside of the body, the cleaning strip assembly comprising an elongate support member housed within an underside of the wall, a flexible strip extending along substantially the entire length of the elongate support member, and a plurality of tabs for engaging a surface being cleaned, the engagement of the plurality of tabs with the surface being capable of causing the cleaning strip assembly to pivot between a cleaning position and an elevated position.

43. The apparatus of claim 42, wherein the flexible strip extends radially from the support member along substantially the entire length of the elongate support member.

44. The apparatus of claim 43, wherein the elongate support member extends along substantially the entire length of the body.

45. The apparatus of claim 42, further comprising an intermediate compartment defined by the wall, which is between the forward compartment and the intermediate compartment, a wall between the intermediate compartment and the rear compartment, and side walls.

46. The apparatus of claim 45, wherein the wall between the forward and intermediate compartments is inclined rearwardly.

47. The apparatus of claim 45, wherein the wall between the intermediate and rear compartments seals the rear compartment from the intermediate compartment.

48. The apparatus of claim 42, wherein a front part of the forward compartment is movable to expose bristles on the elongate rotatable brush at the front part of the forward compartment.

49. The apparatus of claim 42, wherein the forward compartment further comprises an opening in a lower surface thereof, and wherein a lower front region of the body is chamfered so that bristles of the elongate brush protrude from the body in the region of the chamfer such that, when the apparatus is inclined relative to a surface to be cleaned, contact between the bristles and the surface to be cleaned is increased.

* * * * *